US009381631B2

(12) United States Patent
Ullbors et al.

(10) Patent No.: US 9,381,631 B2
(45) Date of Patent: Jul. 5, 2016

(54) CRIMPING TOOL AND CRIMPING DIE

(71) Applicant: Pressmaster AB, Älvdalen (SE)

(72) Inventors: Daniel Ullbors, Mora (SE); Niklas Jonasson, Färnäs (SE)

(73) Assignee: Pressmaster AB, Älvdalen (SE)

( * ) Notice: Subject to any disclaimer, the term of this patent is extended or adjusted under 35 U.S.C. 154(b) by 0 days.

(21) Appl. No.: 14/718,193

(22) Filed: May 21, 2015

(65) Prior Publication Data

US 2015/0349478 A1 Dec. 3, 2015

(30) Foreign Application Priority Data

May 28, 2014 (SE) ..... 1400271

(51) Int. Cl.

| | |
|---|---|
| ***B25B 7/12*** | (2006.01) |
| ***B25B 27/10*** | (2006.01) |
| ***B25B 27/14*** | (2006.01) |
| ***H01R 43/042*** | (2006.01) |

(52) U.S. Cl.

CPC ..... *B25B 27/10* (2013.01); *B25B 27/146* (2013.01); *H01R 43/0424* (2013.01)

(58) Field of Classification Search

CPC ... B25B 27/10; B25B 27/146; H01R 43/0424
USPC ..... 72/409.12
See application file for complete search history.

(56) References Cited

U.S. PATENT DOCUMENTS

| | | | | |
|---|---|---|---|---|
| 367,221 | A | 7/1887 | Rolfes | |
| 4,614,107 | A * | 9/1986 | Norin | H01R 43/0424 72/402 |
| 6,176,116 | B1 * | 1/2001 | Wilhelm | B25B 27/146 72/402 |
| 7,874,193 | B2 * | 1/2011 | Norin | H01R 43/0424 72/402 |
| 7,997,116 | B2 * | 8/2011 | Norin | B25B 27/10 72/409.08 |
| 8,474,299 | B2 * | 7/2013 | Lutze | H01R 43/0424 72/402 |

FOREIGN PATENT DOCUMENTS

| | | |
|---|---|---|
| DE | 198 58 719 A1 | 6/2000 |
| EP | 0 158 611 A2 | 10/1985 |
| EP | 1 820 607 A2 | 8/2007 |
| WO | WO 90/00098 | 1/1990 |
| WO | WO 2012/046163 A1 | 4/2012 |

* cited by examiner

*Primary Examiner* — David B Jones
(74) *Attorney, Agent, or Firm* — Blank Rome LLP

(57) ABSTRACT

A hand operated crimping tool with at least three crimping dies, the crimping surfaces of which together enclose a crimp opening arranged to receive a workpiece to be crimped. The crimping dies have movable pivot points that move when the handles of the tool are moved relative to each other. Each of the crimping dies is arranged between two guide elements on the body of the crimping tool and further has a respective cam surface and a respective stop surface, the respective cam surface being arranged to cooperate with a guide surface on one of the guide elements and the respective stop surface being arranged to cooperate with a guide surface on the other one of the guide elements, thus guiding the movement of the respective crimping die when the pivot points for the crimping dies are moved relative to the body of the crimping tool.

11 Claims, 4 Drawing Sheets

CRIMPING TOOL AND CRIMPING DIE

FIELD OF THE INVENTION

The present invention relates to a crimping tool comprising crimping dies and also to a crimping die for a crimping tool.

BACKGROUND OF THE INVENTION AND RELATED ART

Cable termination tooling may comprise e.g. cutting tools, stripping tools and crimping tools.

Some tools only have one of the above functions, whereas other tools have two or three of the above functions. Tools for cable termination may be hand tools or powered tools, e.g. hydraulically powered tools. Cable termination is required e.g. for connecting a cable or a wire to power, coaxial, fiber-optic or modular connectors.

When crimping, a connector i.e. a terminal, splice, contact or a similar device is mechanically secured to a cable—e.g to a conductor such as a wire—by deformation so that a solid joint having reliable mechanical and electrical connection is formed. The crimping operation resulting in a crimped joint is e.g. performed using crimping dies.

DE 198 58 719 A1 shows a hand operated crimping tool having an two-part-frame for adjusting the position of the crimping dies which crimping dies are pivotally mounted and axially fixed to the body of the crimping tool, i.e. the pivot points for the crimping dies are fixed relative to the body of the tool. Thus, a sliding movement occurs on the contact surface between the crimping dies and the workpiece to be crimped during the crimping operation. An elastic element is arranged attached to a handle for force compensation at high press forces.

U.S. Pat. No. 6,176,116 B1 shows a hand operated crimping tool with crimping dies that are pivotally mounted and axially fixed to the body of the crimping tool, i.e. the pivot points for the crimping dies are fixed relative to the body of the tool. An elastic element is arranged attached to a handle for force compensation at high press forces.

EP 1 820 607 A2 shows a hand operated crimping tool with crimping dies having pivot points arranged movable in relation to the body of the crimping tool. An elastic element is arranged pivotably attached to a handle for force compensation at high press forces.

EP 0 158 611 A2 shows a hand operated crimping tool with a slot in which a stud attached to a link is arranged to move against a spring force.

SUMMARY OF THE INVENTION

The primary object of the present invention is to provide a hand operated crimping tool with improved guiding of the movement of the crimping dies relative to the body of the tool. An object of the present invention is also to provide an improved crimping die for a crimping tool.

The above mentioned object is achieved for a device having the features stated in claims 1 and 11, respectively.

These and other advantageous features will be apparent from the detailed description below.

The invention will now be described in more detail below with reference to the appended drawings which illustrate preferred embodiments of the device according to the invention.

DESCRIPTION OF PREFERRED EMBODIMENTS

Figure 1:
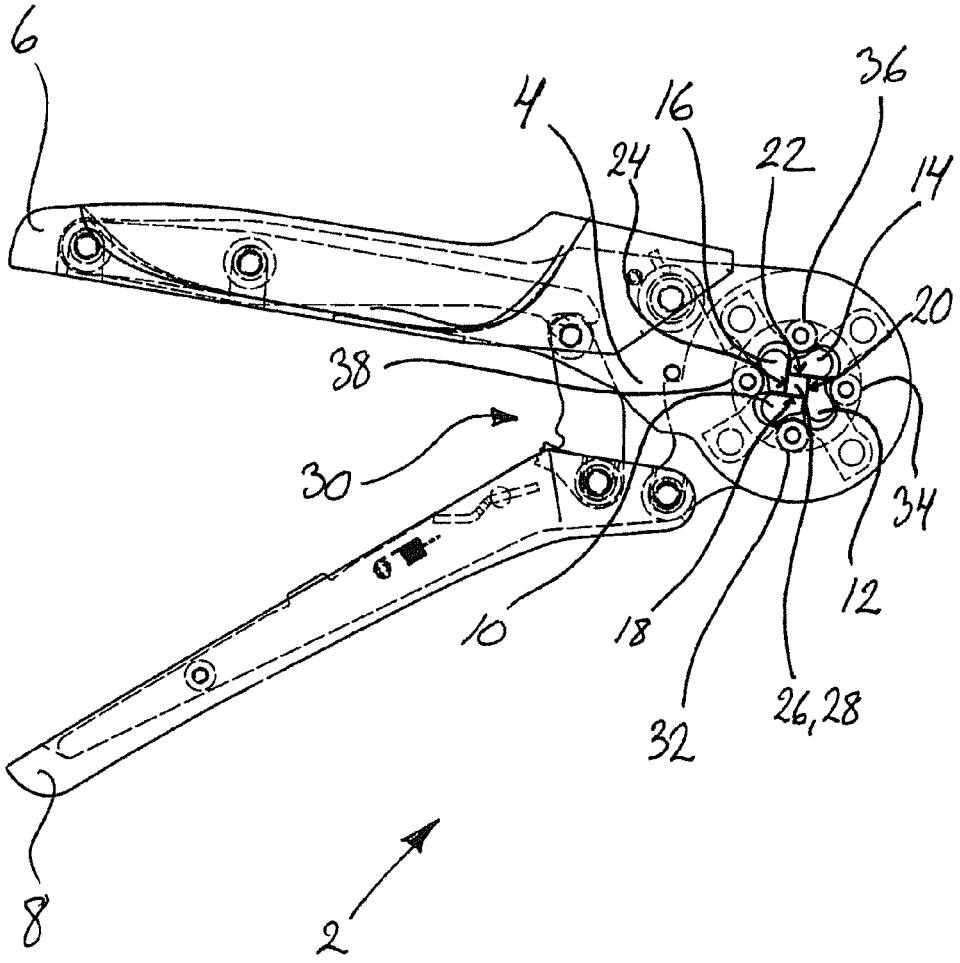
FIG. 1 shows schematically a side view of a crimping tool according to the invention in an open position, i.e. before the crimping stroke.

The same reference numerals are being used for similar features in the different drawings.

FIG. 1 shows schematically a side view of a hand operated crimping tool 2 according to the invention in an open position, i.e. before the crimping stroke. The parts of the tool 2 obscured by other parts are shown with broken lines for better understanding of how the tool operates. The hand operated crimping tool 2 comprises a tool body 4 and two handles 6, 8, which handles 6, 8 are movably arranged in relation to each other, and further comprises at least three crimping dies 10, 12, 14, 16, where each of the crimping dies 10, 12, 14, 16 has a respective crimping surface 18, 20, 22, 24, where the crimping surfaces 18, 20, 22, 24 together enclose a crimp opening 26 arranged to receive a workpiece 28 to be crimped during the crimping operation. The crimping dies 10, 12, 14, 16 have pivot points (see FIG. 2) that are arranged movable in relation to the body 4 of the crimping tool 2, where the relative movement of the tool handles 6, 8 is connected to the relative movement of the crimping dies 10, 12, 14, 16 by that a linkage 30 is arranged to guide the movement of the pivot points (see FIG. 2) of the crimping dies 10, 12, 14, 16 relative to the body 4 of the crimping tool 2 when the tool handles 6, 8 are moved in relation to each other. Each of the crimping dies 10, 12, 14, 16 is further arranged between two guide elements 38, 32; 32, 34; 34, 36; 36, 38 arranged on the body 4 of the crimping tool 2 and further has a respective cam surface (see FIG. 2) and a respective stop surface (see FIG. 2), where the respective cam surface (see FIG. 2) is arranged to cooperate with a guide surface (see FIG. 2) on one of the guide elements 38, 32; 32, 34; 34, 36; 36, 38 and the respective stop surface (see FIG. 2) is arranged to cooperate with a guide surface (see FIG. 2) on the other of the guide elements 38, 32; 32, 34; 34, 36; 36, 38, thus guiding the movement of the respective crimping die 10, 12, 14, 16 when the pivot points (see FIG. 2) of the crimping dies 10, 12, 14, 16 are moved relative to the body 4 of the crimping tool 2.

Figure 2:
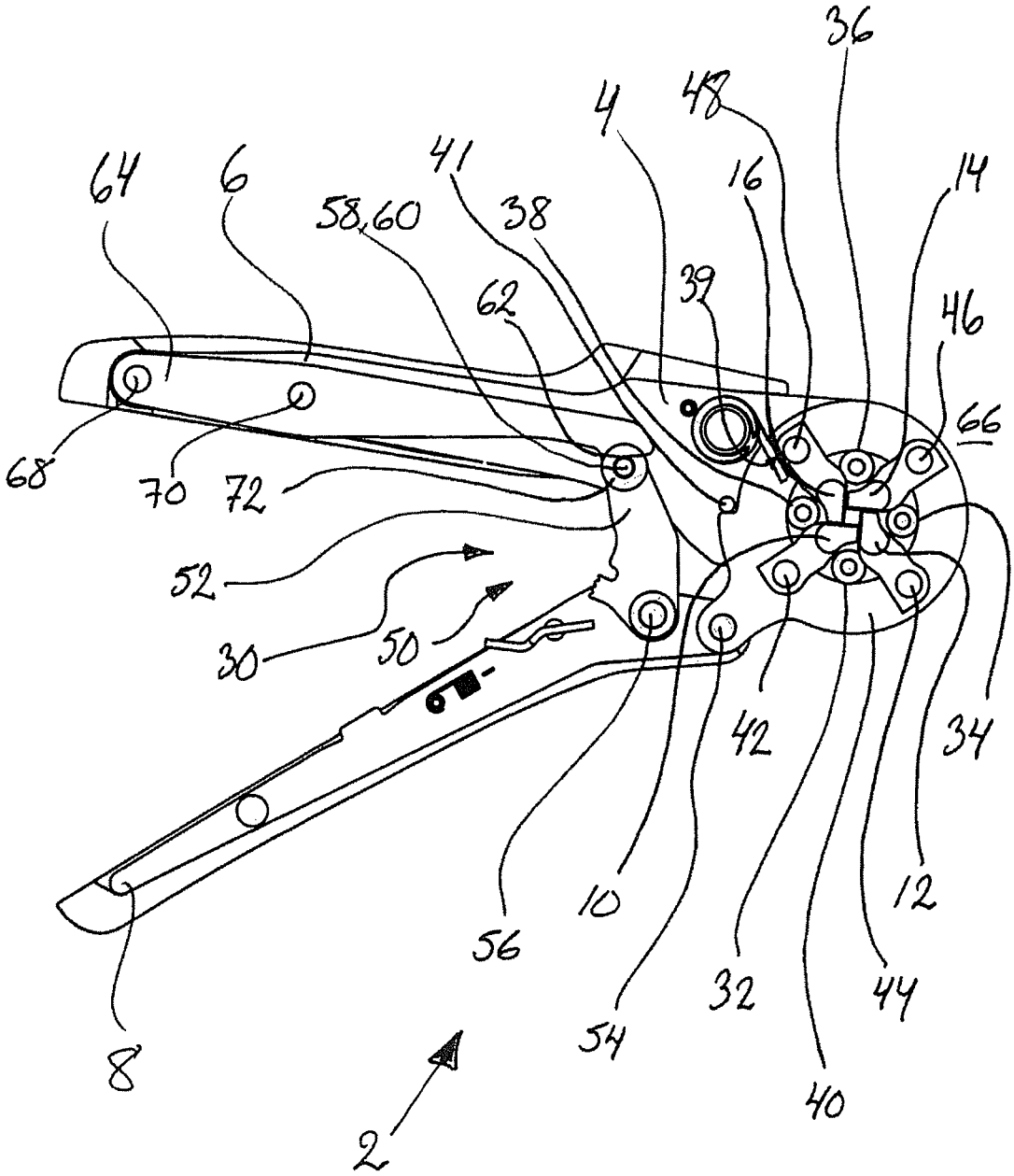
FIG. 2 shows schematically a side section of a crimping tool according to FIG. 1 in an open position, showing four crimping dies and four guide elements.

FIG. 2 shows schematically a side section of a crimping tool according to FIG. 1 in an open position, showing four crimping dies 10, 12, 14, 16 and four guide elements 32, 34, 36, 38. The figure further shows the linkage 30 arranged to guide the movement of the pivot points 42, 44, 46, 48 for the crimping dies 10, 12, 14, 16, which linkage 30 in this embodiment comprises a guide plate 40 arranged to be able to turn about the guide elements 32, 34, 36, 38 and where the pivot points 42, 44, 46, 48 for the crimping dies 10, 12, 14, 16 are arranged on the guide plate 40, the pivot points 42, 44, 46, 48 thus being arranged movable in relation to the body 4 of the crimping tool 2, and further comprises a toggle mechanism 50. The crimping dies 10, 12, 14, 16 are pivotally mounted and axially fixed, near their respective ends, on the guide plate 40. The guide plate 40 is in turn moved by the toggle mechanism 50 comprising a movable handle 8 and a toggle lever 52 that are pivotally connected as can be seen in the figure at respective pivot points 54, 56, 58. In this embodiment, the other handle 6 is arranged as a fixed handle being a part of the tool body 4, e.g. integrated in the tool body 4. In order to allow for large press forces without breaking the toggle mechanism 50, the toggle lever 52 is attached to the fixed handle 6 by using a pin 60 arranged to be guided along a slot 62 in the fixed handle 6 where a spring member 64 is arranged to press the pin 60 towards the end of the slot 62 situated closer to the tool head 66 and where the toggle lever 52 is arranged to push the pin 60 away from this end of the slot 62 against the force of the spring member 64 when the handles 6, 8 are forced towards each other. This can e.g. be the case at the end of the crimping operation when the workpiece (see FIG. 1) to be crimped can not decrease in cross-sectional area any longer. A rotating sleeve 72 can be arranged on the pin 60 in order to decrease friction between the pin 60 and the spring member 64. The spring member 64 is preferably arranged fastened to the fixed handle 6 as shown in the figure, e.g. by using pins 68, 70. The spring member 64 and the slot 62 are optional, but without them the linkage 30 will have a shorter life span due to larger forces exerted thereon.

The figure also shows one preferred way of realizing an automatic return movement for the tool handles 6, 8 after the crimping operation, where here a return spring 39 is arranged to push the guide plate 40 towards an end position against an end stop member 41 arranged on the tool body 4 thus returning the tool into the open position when the tool handles 6, 8 are not operated, which return movement is realized in this embodiment by the return spring 39 acting on a crimping die 16 which is pivotably arranged on the guide plate 40.

Figure 3:
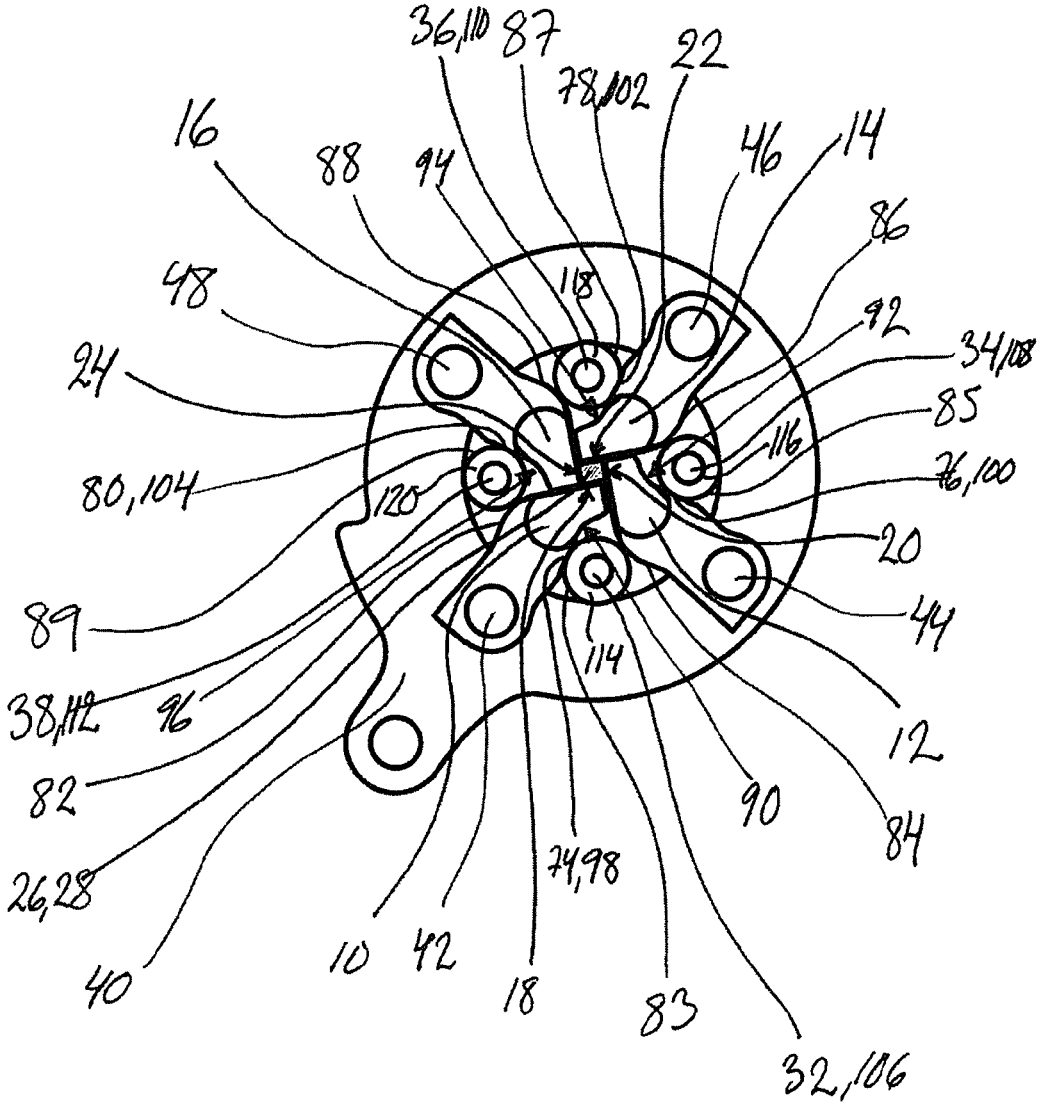
FIG. 3 shows the four crimping dies and four guide elements shown in FIG. 2 in an enlarged view in a partly closed position.

FIG. 3 shows the four crimping dies 10, 12, 14, 16 with their respective crimping surface 18, 20, 22, 24, four guide elements 32, 34, 36, 38 and the guide plate 40 shown in FIG. 2 in an enlarged view in a partly closed position, i.e. during the crimping stroke. The crimping surfaces 18, 20, 22, 24 together enclose a crimp opening 26 arranged to receive a workpiece 28 to be crimped during the crimping operation. Each of the crimping dies 10, 12, 14, 16 is further arranged between two of the guide elements 38, 32; 32, 34; 34, 36; 36, 38 arranged on the body (not shown) of the crimping tool and further has a respective cam surface 74, 76, 78, 80 and a respective stop surface 82, 84, 86, 88, where the respective cam surface 74, 76, 78, 80 is arranged to cooperate with a guide surface 83, 85, 87, 89 on one of the guide elements 38, 32; 32, 34; 34, 36; 36, 38 and the respective stop surface 82, 84, 86, 88 is arranged to cooperate with a guide surface 83, 85, 87, 89 on the other one of the guide elements 38, 32; 32, 34; 34, 36; 36, 38, thus guiding the movement of the respective crimping die 10, 12, 14, 16 when the pivot points 42, 44, 46, 48 for the crimping dies 10, 12, 14, 16 are moved relative to the body (not shown) of the crimping tool. The respective cam surface 74, 76, 78, 80 preferably comprises two sections, one section 90, 92, 94, 96 arranged to enable a large crimp opening 26 in the open position of the tool (see FIG. 4), and one section 98, 100, 102, 104 against which the guide surface 83, 85, 87, 89 of the respective guide element 32, 34, 36, 38 is arranged to abut during the crimping operation, i.e. as shown in FIG. 3. All of the respective sections 90, 92, 94, 96, 98, 100, 102, 104 of the respective cam surface 74, 76, 78, 80 are preferably arranged curved in the same direction as the respective guide surface 83, 85, 87, 89 of the respective guide element 32, 34, 36, 38, e.g. arranged as circular arcs. The respective sections 98, 100, 102, 104 against which the guide surface 83, 85, 87, 89 of the respective guide element 32, 34, 36, 38 is arranged to abut during the crimping operation can also optionally be straight. When crimping, the respective cam surface 74, 76, 78, 80 moves along the respective guide surface 83, 85, 87, 89, and abuts thereon at least during the crimping operation.

The guide elements 32, 34, 36, 38 may e.g. be pins or optionally comprise pins 106, 108, 110, 112 with thereon arranged rotating rollers 114, 116, 118, 120 which allows for less friction between the guide elements 32, 34, 36, 38 and the crimping dies 10, 12, 14, 16. All of the guide elements 32, 34, 36, 38 may have substantially the same outer diameter which gives a substantially square crimp opening 26. Optionally, the guide elements 32, 34, 36, 38 may have more than one outer diameter, if e.g. four guide elements 32, 34, 36, 38 are arranged and where two opposing guide elements 32, 36 have one outer diameter and two other also opposing guide elements 34, 38 have another outer diameter, the crimp opening may be rectangular but not square. If rollers are arranged, it is possible to replace them with rollers having a different outer diameter thus adjusting the size of the crimp opening 26.

Figure 4:
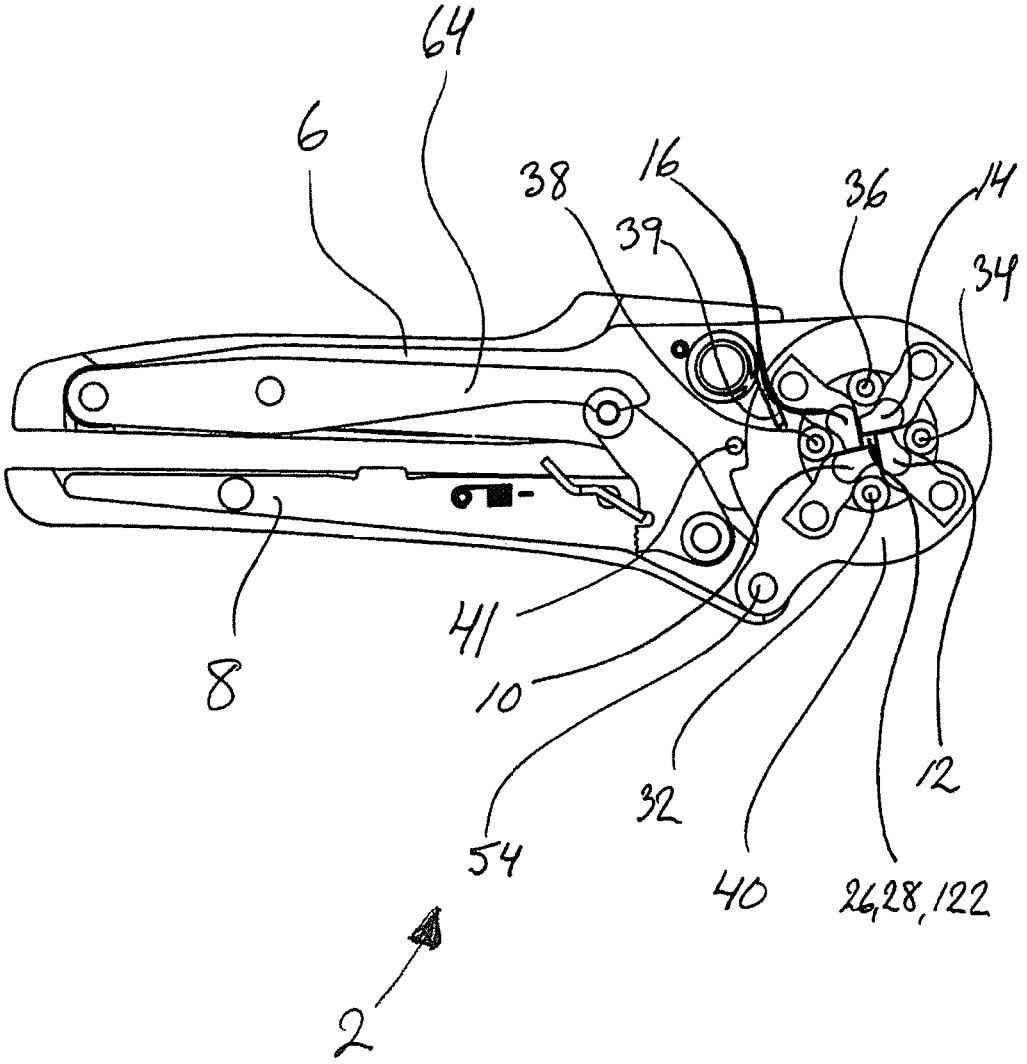
FIG. 4 shows schematically a side section of the crimping tool according to FIG. 2 in a partly closed position, i.e. during the crimping stroke.

FIG. 4 shows schematically a side section of the crimping tool 2 according to FIG. 2 in a partly closed position, i.e. during the crimping stroke.

The crimping tool 2 operates in the following manner:

Firstly, a workpiece 28 to be crimped such as a connector or a similar device is inserted into the opening 26 delimited by the crimping dies 10, 12, 14, 16.

After insertion of the workpiece 28, the crimping tool 2 is operated by gently squeezing the handles 6,8 together making the crimping dies 10, 12, 14, 16 move slightly against each other thereby coming into contact with and exerting pressure on the workpiece 28 to be crimped so that the workpiece 28 to be crimped is held in place without being deformed. This enables easy insertion of a cable 122, e.g. a stripped portion of a wire, into the workpiece 28 to be crimped.

Now see FIGS. 1 to 4:

When the workpiece 28 and the cable 122 are aligned in a satisfactory way, the handles 6,8 are further squeezed together which makes the crimping dies 10, 12, 14, 16 move against each other. The respective guide surface 83, 85, 87, 89 of the respective guide element 32, 34, 36, 38 has now moved from the first section 90, 92, 94, 96 of the respective cam surface 74, 76, 78, 80 to the second section 98, 100, 102, 104 thereof when the handles 6,8 are brought together to a position where the workpiece 28 is engaged by the crimping dies 10, 12, 14, 16.

When the handles 6,8 are brought further together, this results in a crimped joint, in this embodiment with a square cross-section, with the workpiece 28 crimped about the cable 122. The spring element 64 is somewhat elastically deformed when the handles 6, 8 are brought further together, thus acting as a spring balancing the forces between the handles 6,8 and the crimping dies 10, 12, 14, 16 in order to compensate for different dimensions of the workpiece 28 which are within the range of allowed workpiece 28 cross-section dimensions. Optionally, the crimping tool comprises a well known adjusting mechanism (not shown) arranged at the pivot point "54" which adjusting mechanism comprises an eccentric member which when turned about the pivot point "54" changes the relative position between the handle 8 and the guide plate 40 at the pivot point "54" thus in turn changing the range of the dimensions of the crimp opening 26 this allowing for a broader range of allowed workpiece 28 cross-section dimensions, e.g. changing the crimping range from a first range of e.g. 0.1-6 $mm^2$ to another crimping range of e.g. approximately 10-16 $mm^2$, where the eccentric member may be kept in position by a spring loaded locking mechanism. As can be seen in FIG. 4, the return spring 39 is moved by the crimping die 16 which is pivotably arranged on the guide plate 40, and the guide plate 40 is moved away from the open end position and the end stop member 41 arranged on the tool body 4 when the tool handles 6, 8 are operated by pushing them towards each other.

Finally the handles 6,8 are released which allows for movement of the crimping dies 10, 12, 14, 16 apart thereby allowing removal of the crimped connector 28 from the crimping tool 2.

Preferably, the crimping dies, 10, 12, 14, 16 are made of a number of thin sheets of metal, i.e. that the respective crimping die 10, 12, 14, 16 comprises a number of thin sheets of metal, which allows for forming of the sheets by punching and subsequent assembly of a number of thin sheets together to form a crimping die 10, 12, 14, 16 which decreases the manufacturing costs and at the same time increases the manufacturing accuracy.

What is claimed is:

1. Hand operated crimping tool comprising a tool body and two handles, which handles are movably arranged in relation to each other, and further comprising at least three crimping dies, where each of the crimping dies has a respective crimping surface, where the crimping surfaces together enclose a crimp opening arranged to receive a workpiece to be crimped, where the crimping dies have pivot points that are movable in relation to the body of the crimping tool, where the tool handles are connected to the crimping dies by a linkage that is arranged to guide the movement of the pivot points for the crimping dies relative to the tool body when the tool handles are moved in relation to each other, wherein the tool body has a plurality of guide elements arranged thereon, each of the guide elements having a guide surface, and wherein each of the crimping dies is arranged between two of the guide elements, and wherein each of the crimping dies further has a cam surface and a stop surface, where the cam surface of each of the crimping dies is arranged to cooperate with the guide surface on one of the two guide elements and wherein the stop surface of each of the crimping dies is arranged to cooperate with the guide surface on the other one of the two guide elements, thus guiding the movement of the crimping die arranged between the two guide elements when the pivot points for the crimping dies are moved relative to the tool body.

2. Crimping tool according to claim 1, wherein the linkage comprises a guide plate arranged to turn about the guide elements and wherein the linkage further comprises a toggle mechanism, and wherein the pivot points for the crimping dies are arranged on the guide plate.

3. Crimping tool according to claim 2, wherein one handle is arranged as a fixed handle integrated in the tool body, and a toggle lever is attached to the fixed handle by using a pin arranged to be guided along a slot in the fixed handle, where a spring member is arranged to press the pin towards the end of the slot situated closer to the tool head and where the toggle lever is arranged to push the pin away from this end of the slot against the force of the spring member when the handles are forced towards each other.

4. Crimping tool according to claim 3, wherein a rotating sleeve is arranged on the pin in order to decrease friction between the pin and the spring member.

5. Crimping tool according to claim 2, wherein the crimping dies are pivotally mounted and axially fixed, near their respective ends, on the guide plate.

6. Crimping tool according to claim 1, wherein the cam surface of each of the crimping dies comprises two sections, one section arranged to enable a large crimp opening in the open position of the tool and one section against which the guide surface of the respective guide element is arranged to abut during the crimping operation.

7. Crimping tool according to claim 6, wherein the sections of the cam surface of each of the crimping dies are curved in the same direction as the guide surface of the respective guide element.

8. Crimping tool according to claim 1, wherein each of the guide elements comprises a pin with a rotating roller mounted thereon.

9. Crimping tool according to claim 8, wherein all of the guide elements have substantially the same outer diameter.

10. Crimping tool according to claim 8, comprising four guide elements, where two opposing ones of the four guide elements have one outer diameter and two other opposing ones of the four guide elements have another outer diameter.

11. Crimping die for crimping tool according to claim 1, wherein the each of the crimping dies comprises a number of thin sheets of metal.

* * * * *